US007063164B2

(12) United States Patent
Hilsman et al.

(10) Patent No.: US 7,063,164 B2
(45) Date of Patent: Jun. 20, 2006

(54) SYSTEM AND METHOD TO SEAL BY BRINGING THE WALL OF A WELLBORE INTO SEALING CONTACT WITH A TUBING

(75) Inventors: Youel G. Hilsman, Friendswood, TX (US); Herve Ohmer, Houston, TX (US); Dinesh R. Patel, Sugar Land, TX (US); Stephane Hiron, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/708,931

(22) Filed: Apr. 1, 2004

(65) Prior Publication Data

US 2005/0217849 A1 Oct. 6, 2005

(51) Int. Cl.
*E21B 33/10* (2006.01)

(52) U.S. Cl. ..... 166/387; 166/179

(58) Field of Classification Search ..... 166/116, 166/114, 193, 179, 277, 301, 387; 299/17

See application file for complete search history.

(56) References Cited

U.S. PATENT DOCUMENTS

| | | | | | |
|---|---|---|---|---|---|
| 1,641,035 | A | * | 8/1927 | Alfred | 166/387 |
| 2,187,480 | A | * | 1/1940 | Hero | 166/116 |
| 2,957,525 | A | * | 10/1960 | Kemnitz | 166/117.5 |
| 3,216,503 | A | * | 11/1965 | Fisher, Jr. et al. | 166/116 |
| 3,399,724 | A | * | 9/1968 | Brooks | 166/301 |
| 3,727,685 | A | * | 4/1973 | Chestnut et al. | 166/255.1 |
| 4,063,427 | A | * | 12/1977 | Hoffman | 405/225 |
| 4,091,868 | A | * | 5/1978 | Kozlowski et al. | 166/277 |
| 4,892,144 | A | | 1/1990 | Coone | |
| 4,913,232 | A | | 4/1990 | Cheymol et al. | |
| 5,058,673 | A | | 10/1991 | Muller et al. | |
| 6,523,610 | B1 | * | 2/2003 | Griffith et al. | 166/277 |

* cited by examiner

*Primary Examiner*—Hoang Dang
(74) *Attorney, Agent, or Firm*—Robert A. Van Someren; Kevin P. McEnaney; Jaime A. Castano

(57) ABSTRACT

The invention is a system and method used to seal between an open wellbore and a tubing by bringing the wellbore wall inwardly so as to enable sections of earth from the wellbore wall to create the required seal against the tubing. The earth sections that make up the seal can be created by collapsing the relevant parts of the wellbore wall inwardly or by causing the relevant parts of the wellbore wall to swell inwardly.

26 Claims, 5 Drawing Sheets

SYSTEM AND METHOD TO SEAL BY BRINGING THE WALL OF A WELLBORE INTO SEALING CONTACT WITH A TUBING

BACKGROUND OF INVENTION

The invention generally relates to a system and method to seal by bringing the wall of a subterranean wellbore into sealing contact with an interior tubing. More specifically, the invention relates to a sealing system that causes the wall of a wellbore to collapse or swell and thereby provide a seal against a tubing located within the wellbore.

Sealing systems, such as packers or anchors, are commonly used in the oilfield. Packers, for instance, are used to seal the annular space between a tubing string and a surface exterior to the tubing string, such as a casing or an open wellbore. Commonly, packers are actuated by hydraulic pressure transmitted either through the tubing bore, annulus, or a control line. Other packers are actuated via an electric line deployed from the surface of the wellbore.

The majority of packers are constructed so that when actuated they provide a seal in a substantially circular geometry. However, in an open wellbore, packers are required to seal in a geometry that is typically not substantially circular.

Thus, there is a continuing need to address one or more of the problems stated above.

SUMMARY OF INVENTION

The invention is a system and method used to seal between an open wellbore and a tubing by bringing the wellbore wall inwardly so as to enable sections of earth from the wellbore wall to create the required seal against the tubing. The earth sections that make up the seal can be created by collapsing the relevant parts of the wellbore wall inwardly or by causing the relevant parts of the wellbore wall to swell inwardly.

Advantages and other features of the invention will become apparent from the following drawing, description and claims.

DETAILED DESCRIPTION

Figure 1:
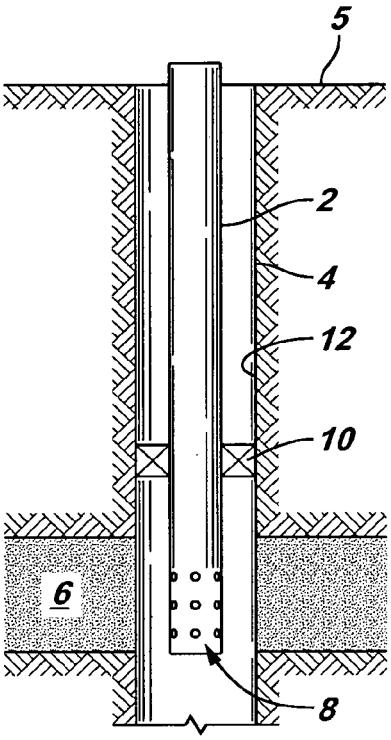
FIG. 1 (Prior Art)
FIG. 1 is an illustration of a prior art wellbore and packer.

FIG. 1 illustrates a prior art system, in which a tubing 2 is deployed in a wellbore 4 that extends from the surface 5 and intersects a formation 6. Typically and depending on whether the wellbore is a producing or injecting wellbore, hydrocarbons (such as oil or gas) are either produced from the formation 6, into the wellbore 4, into the tubing 2 through tubing openings 8 (such as slots or valves), and to the surface 5, or fluids (such as water or treating fluid) are injected from the surface 5, down the tubing 2, through the openings 8, and into the formation 6. In the prior art, a packer 10 is usually deployed on the tubing 2 to anchor the tubing 2 against the wellbore wall 12. Packer 10 also seals against the wellbore wall 12 in order to restrict the path of the fluid being produced or injected to below the packer 10. In some embodiments, packer 10 isolates a shale section in the earth from the formation 6 to prevent shale migration in the annulus below the packer 10. As is known in the art, shale can plug sand screens that may be used as a sand filter prior to the openings 8. When more than one formation is intersected by a wellbore, packers are also used to isolate formations from each other. Zonal isolation is useful in order to independently control the flow from each formation, and, if desired, to avoid co-mingling of formation effluents.

Figure 2:
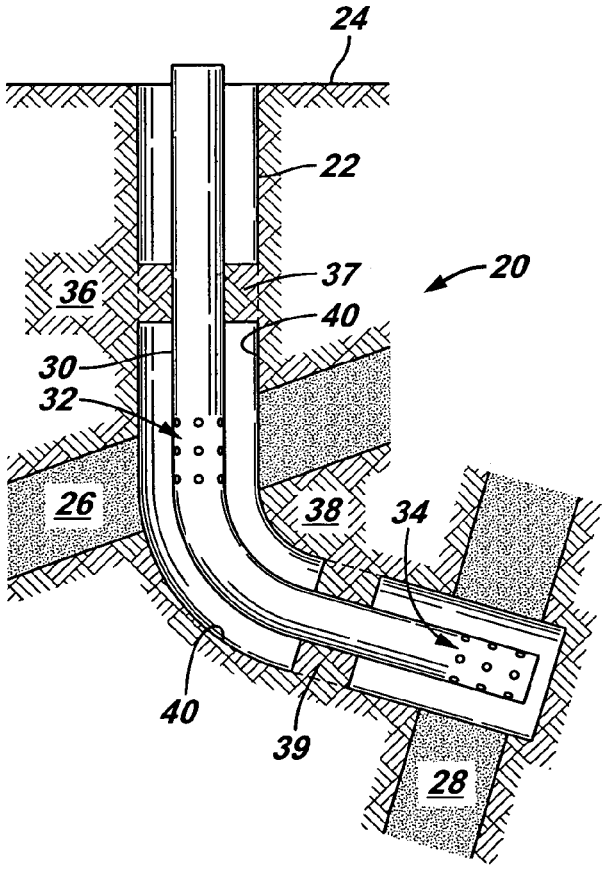
FIG. 2 is an illustration of the present invention.

A general schematic of the present invention 20 is illustrated in FIG. 2. In this Figure, a wellbore 22 extends from the surface 24 and intersects at least one formation 26, 28 (two formations are shown). Zones 36, 38 of earth, which can be made up of a variety of geological characteristics, are typically located between formations 26, 28. A tubing 30 is deployed within the wellbore 22, which tubing 30 includes openings 32, 34 that provide fluid communication between the interior of the tubing 30 and a corresponding formation 26, 28. As described with respect to FIG. 1, wellbore 22 can be a producing or an injecting wellbore (determined by whether fluid flows out of or into the formations). Formation 26, 28 may include hydrocarbons.

Instead of utilizing a packer or another tool carried on the tubing to seal against the wellbore wall 40, the present invention 20 brings the wall 40 (or sections 37, 39 thereof) into sealing engagement with the tubing 30. The earth sections 37, 39 that create the requisite seal against tubing 30 are created either by collapsing the relevant parts of zones 36, 38 inwardly (such as by either mechanically, hydraulically, or explosively unloading the sections) or by causing the relevant parts of zones 36, 38 to swell inwardly. In other words, the present invention alters the chemical and/or mechanical conditions of the wellbore to bring the wall of the wellbore into sealing contact with the tubing 30.

Figure 3:
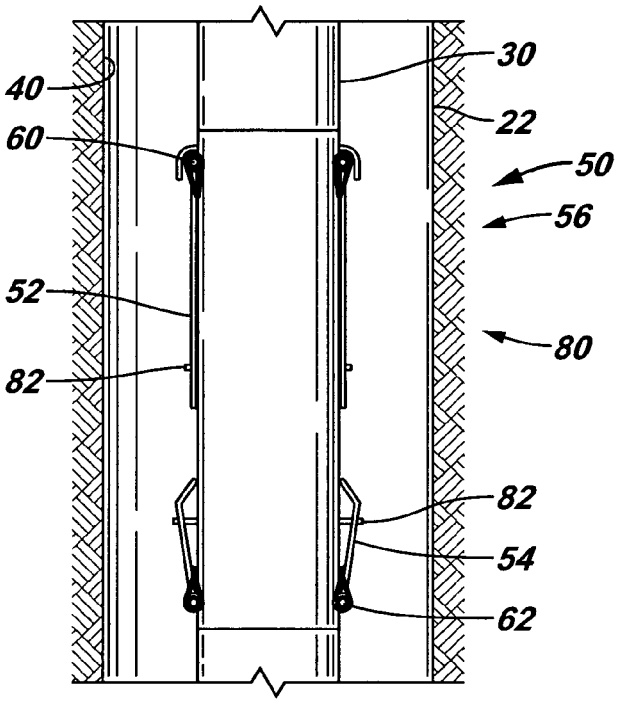
FIG. 3 shows the inactive state of one embodiment of the present invention.
Figure 4:
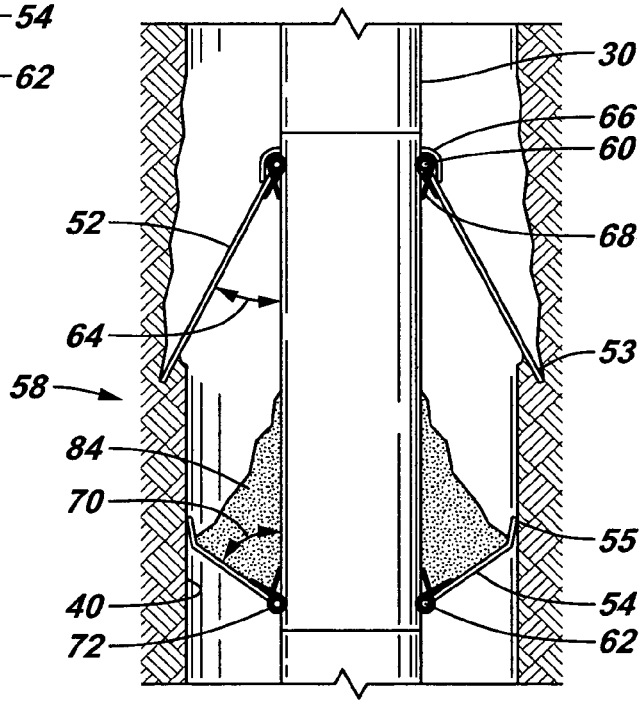
FIG. 4 shows the active state of the embodiment of FIG. 3.

FIGS. 3 and 4 illustrate one embodiment that can be used to mechanically unload the relevant parts of a zone 36, 38 and wall 40. In this embodiment, a sealing unit 50 of the present invention is incorporated along the tubing 30 at each location where a seal is required along the wellbore 22. Each sealing unit 50 includes at least one scraper arm 52 and a holder 54. FIG. 3 shows the sealing unit 50 in its inactive state 56, while FIG. 4 shows the sealing unit 50 in its active state 58.

It is understood that tubing 30 can comprise a plurality of tubing sections, each of which is deployed separately into the wellbore and some of which can include a sealing unit 50.

In the inactive state 56, the scraper arms 52 and holder 54 are not deployed outwardly and are located proximate the sealing unit 50 or tubing 30. In one embodiment, each scraper arm 52 is pivotably connected to the sealing unit 50 at a pivot point 60. Each scraper arm 52 may be constructed from a material hard enough to scrape the earth proximate the wellbore wall 40. Satisfactory materials for scraper arm 52 include metal materials commonly used in downhole conditions. Also in one embodiment, the holder 54 is pivotably connected to the sealing unit 50 at a pivot point 62. The holder 54 may be constructed from a material strong enough to support the weight of the earth that makes up the sealing extensions (such as earth sections 37 and 39 of FIG. 2). In the active state 58, the scraper arms 52 and holder 54 are pivoted outwardly toward the wellbore wall 40 about their corresponding pivot points 60, 62.

The length of each scraper arm 52 is such that the arm end 53 distal to the pivot point 60 is embedded in the earth when in the active state 58. In one embodiment, the angle 64 that each scraper arm 52 makes with the sealing unit 50 when in the active state 58 is an acute angle. An arm stop 66 deployed with each scraper arm 52 maintains the scraper arm 52 at no more than the acute angle 64 from the sealing unit 50 thereby preventing the forces applied by the earth as the sealing unit 50 is forced downward from overbending or overpivotting the scraper arms 52. A spring 68, such as a torsion spring, is deployed about the pivot point 60 biasing scraper arm 52 outwardly to become embedded within the earth.

The length of holder 54 is such that the end 55 distal to the pivot point 62 is dragged along the wellbore wall 40 as the sealing unit 50 is forced downward when the sealing unit 50 is in the active state 58. In one embodiment, the holder distal end 55 is bent slightly in the upward direction so as to prevent or reduce the chance of it embedding in the earth. In one embodiment, the angle 70 between the holder 54 and the sealing unit 50 is an acute angle when the sealing unit 50 is in the active state 58. A spring 72, such as a torsion spring, is deployed about the pivot point 62 biasing holder 54 outwardly toward the wellbore wall 40.

The scraper arms 52 and holder 54 are locked in the inactive state 56 by a locking mechanism 80 as the tubing 30 and sealing unit 50 are deployed in the wellbore 22. When the operator is ready to deploy the scraper arms 52 and holder 54, a signal is sent from the surface 24 to the sealing unit 50 to cause the unlocking of the locking mechanism 80 thereby enabling the scraper arms 52 and holder 54 to deploy from the inactive state 56 to the active state 58. Lock mechanism 80 may comprise a shear pin 82 attached between each scraper arm 52 and the sealing unit 50 and a shear pin 82 attached between the holder 54 and the sealing unit 50. In this case, the signal can comprise applied pressure from the surface (transmitted via the tubing 30 interior or via a control line) that shears the shear pins 80, allowing the springs 68, 72 to bias the scraper arms 52 and holder 54 outwardly from the inactive state 56 to the active state 58.

In operation, a sealing unit 50 is incorporated along the tubing 30 at each location where a seal is required along the wellbore 22. The tubing 30 is deployed and when the sealing units 50 are proximate to their appropriate locations, the scraper arms 52 and holder 54 are deployed from the inactive state 52 to the active state 54. The tubing 30 is then forced downwards, which embeds scraper arms 52 into the earth, causing some of the earth 84 proximate the wellbore wall 40 to fall into the annulus and collect and accumulate on top of the holder 54 (which is dragging along the wellbore wall 40). As tubing 30 is forced downward to its appropriate location, earth 84 becomes packed between the scraper arms 52 and the holder 54 thereby providing an effective seal between the tubing 30 and the wellbore wall 40. Thus, earth sections 37 and 39 may be created by this embodiment of the sealing unit 50 to seal against the tubing 30.

Figure 5:
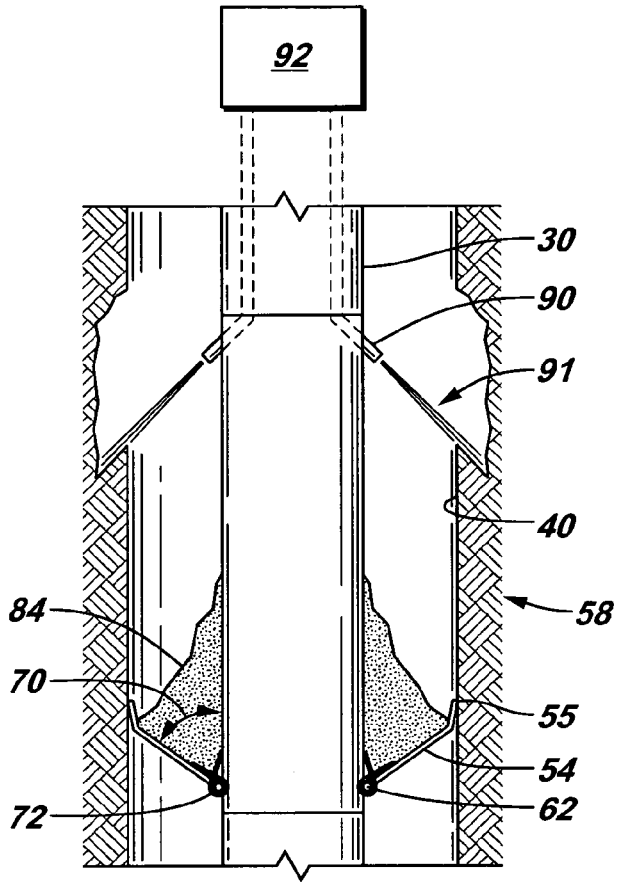
FIG. 5 shows another embodiment of the present invention, including nozzles.

FIG. 5 illustrates one embodiment that can be used to hydraulically unload the relevant parts of a zone 36, 38. In this embodiment, a sealing unit 50 of the present invention is incorporated along the tubing 30 at each location where a seal is required along the wellbore 22. Each sealing unit 50 includes at least one nozzle 90 and a holder 54. The holder 54 may function as described in relation to the embodiment illustrated in FIGS. 3 and 4. Instead of the scraper arms 52, the embodiment of FIG. 5 includes at least one nozzle 90. Each nozzle 90 is in fluid communication with a pressurized fluid source 92 typically located at the surface 24. The fluid communication can be provided through the interior of tubing 30 or through control lines connecting the nozzles 90 and the fluid source 92. Once the tubing 30 and sealing unit 50 are in their appropriate downhole locations, the holder 54 is deployed (as described above) and then the fluid source 92 is activated. The fluid source 92 pumps fluid through the nozzles 90 in a stream 91 and at the wellbore wall 40 with enough force that parts of earth are dislodged from the wellbore wall 40 and accumulate on top of the holder 54. Eventually, earth 84 becomes packed on top of the holder 54 thereby providing an effective seal between the tubing 30 and the wellbore wall 40. Thus, earth sections 37 and 39 may be created by this embodiment of the sealing unit 50 to seal against the tubing 30.

Figure 6:
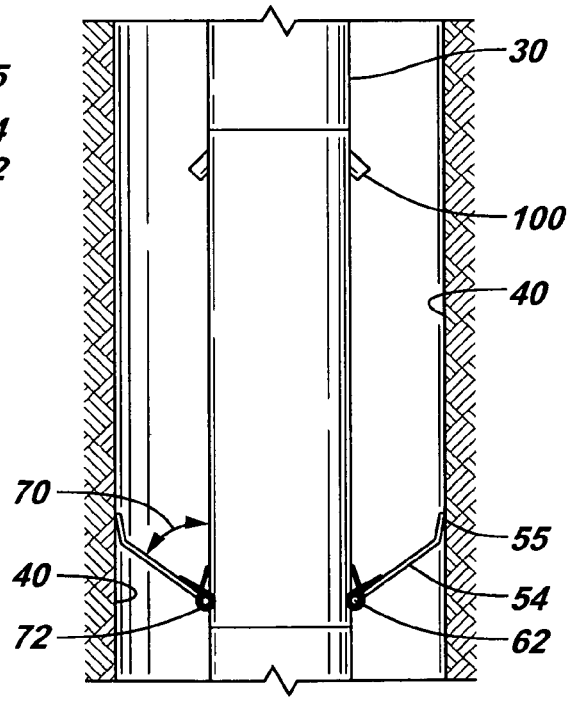
FIG. 6 shows another embodiment of the present invention, including explosives.

FIG. 6 illustrates one embodiment that can be used to explosively unload the relevant parts of a zone 36, 38. In this embodiment, a sealing unit 50 of the present invention is incorporated along the tubing 30 at each location where a seal is required along the wellbore 22. Each sealing unit 50 includes at least one explosive 100 and a holder 54. The holder 54 may function as described in relation to the embodiment illustrated in FIGS. 3 and 4. Instead of the scraper arms 52, the embodiment of FIG. 6 includes at least one explosive 100. Each explosive 100 can be activated as known in the prior art (in relation to perforating guns), such as by signals down control lines, pressure pulses, drop bars, applied pressure, or wireless telemetry (including acoustic, electromagnetic, pressure pulse, seismic, and mechanical manipulation telemetry). It is noted that FIG. 6 illustrates the sealing unit 50 including the explosives 100 prior to activation. When activated, each explosive 100 explodes towards the wall 40 and earth thereby causing a portion of the earth to dislodge from the wellbore wall 40 and accumulate on top of the holder 54. Eventually, earth becomes packed on top of the holder 54 thereby providing an effective seal between the tubing 30 and the wellbore wall 40. Thus, earth sections 37 and 39 may be created by this embodiment of the sealing unit 50 to seal against the tubing 30.

Figure 7:
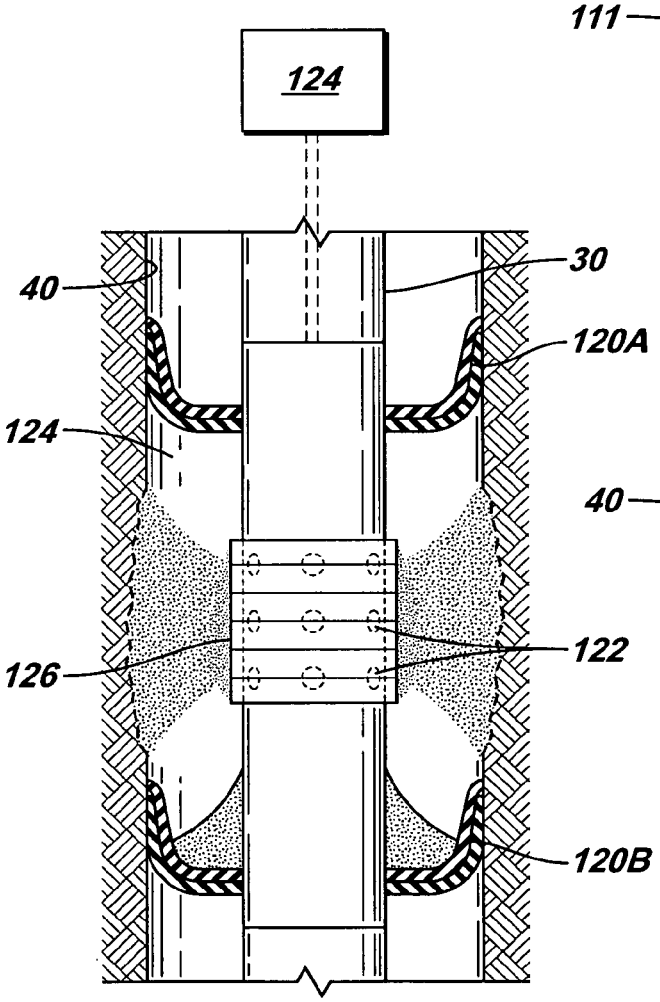
FIG. 7 shows another embodiment of the present invention, including creating a suction.

FIG. 7 illustrates one embodiment that can be used to hydraulically unload the relevant parts of a zone 36, 38. In this embodiment, a sealing unit 50 of the present invention is incorporated along the tubing 30 at each location where a seal is required along the wellbore 22. Each sealing unit 50 includes two sets of rubber cups 120A, 120B and at least one port 122 located on the tubing 30 between the cups, 120A and 120B. Each rubber cup set 120A, 120B may include one or more rubber cups. The interior of tubing 30 is in fluid communication with a suction source 124. To operate this embodiment of the sealing unit 50, the suction source 124 is activated, which results in the creation of a low pressure and suction area in the interior of the tubing 30 as well as in the annulus 124 between the cup sets 120A, 120B (through the ports 122). The cup sets 120A, 120B effectively allow the creation of this suction area therebetween since each set is sized to abut the wellbore wall 40. Once the suction is great enough, it will cause portions of the earth to dislodge from the wellbore wall 40 and flow towards the ports 122. A filter 126 positioned outside of or in the interior of the tubing 30 allows the suction to communicate through the ports 122 but does not allow the dislodged earth sections to flow into tubing 30. After some time, the suction source 124 is deactivated thereby allowing the dislodged earth sections to fall on top of the bottom cup set 120B. Eventually, earth becomes packed on top of the bottom cup set 120B thereby providing an effective seal between the tubing 30 and the wellbore wall 40. Thus, earth sections 37 and 39 may be created by this embodiment of the sealing unit 50 to seal against the tubing 30.

Figure 8:
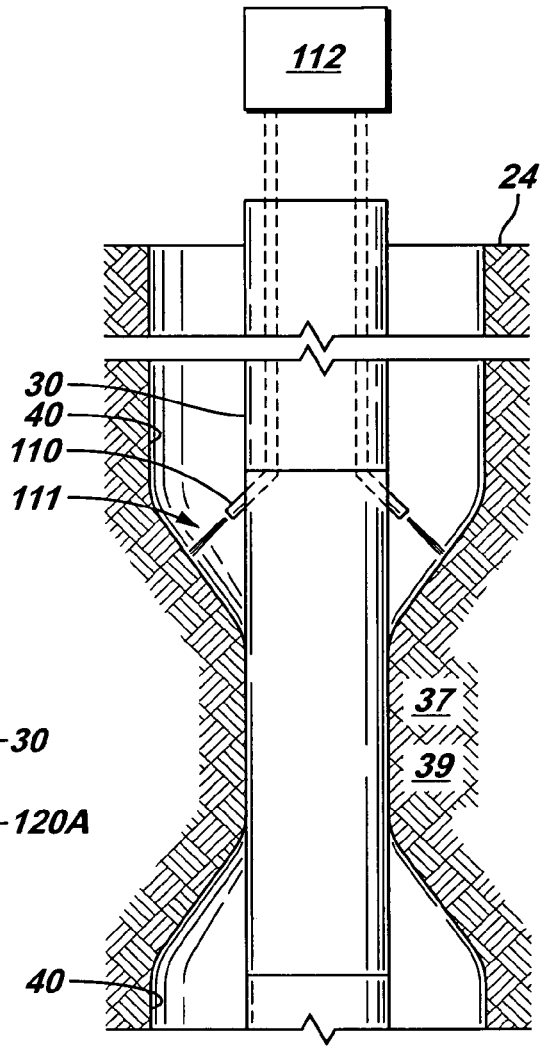
FIG. 8 shows another embodiment of the present invention, including swelling the wellbore wall.

FIG. 8 illustrates one embodiment that can be used to swell the relevant parts of a zone 36, 38. In this embodiment, a sealing unit 50 of the present invention is incorporated along the tubing 30 at each location where a seal is required along the wellbore 22. Each sealing unit 50 includes at least one outlet 110. Each outlet 110 is in fluid communication with a chemical source 112. Although the source 112 is shown as being located at the surface 24, the source 112 may also be located downhole. The fluid communication can be provided through the interior of tubing 30 or through control lines connecting the outlets 90 and the chemical source 92. Once the tubing 30 and sealing unit 50 are in their appropriate downhole locations, the chemical source 112 is activated to distribute fluid through the outlets 110 in a stream 111 at the wellbore wall 40. The chemical distributed by the chemical source 112 is one that causes the relevant parts of zones 36, 38 to swell. The selection of the correct chemical depends on the geological characteristics of the zones 36, 38. The chemical should be selected so that the relevant parts of zones 36, 38 swell to abut and seal against the tubing 30 thereby providing an effective annular seal. Thus, earth sections 37 and 39 may be created by this embodiment of the sealing unit 50 to seal against the tubing 30. The chemical can be in the form of a liquid, gel, or paste. Gel or liquid would prevent free flow. Alternatively, temporary sealing members like rubber packers, cups, etc. can be run with sealing unit 50 to seal off both ends of sealing unit 50 to form a closed chamber. In this embodiment, the chemical is released and retained in the closed chamber.

Chemicals may also be used in conjunction with the embodiments that mechanically, explosively, or hydraulically unload the zones 36, 38 to create the earth sections 37, 39 that seal against the tubing 30. For instance, a chemical to soften the relevant wall section may be distributed on such section before the unloading of the zones 36, 38. Also, a chemical to bond the earth 84 that makes up the earth sections 37, 39 can be distributed after the unloading of the zones 36, 38. Other chemicals may also be used. For instance, a thyxotropic gel can be placed via a ported collar into the annulus, which gel chemistry can alter the borehole conditions triggering a wellbore wall collapse. If chemicals are used, a fluid communication system similar to that described in relation to FIG. 8 would also be implemented.

Combinations of the different sealing unit embodiments are also possible. For instance, the embodiments used to hydraulically or explosively unload the zones 36, 38 may be combined with the embodiments used to mechanically unload the zones 36, 38. Other combinations are possible.

It is noted that the pressure that will be maintained by the earth sections 37, 39 will depend on the porosity and compactness of the earth 84 that makes up the earth sections 37, 39. Such porosity and compactness may be affected to provide a more efficient and thorough seal, such as by adding a chemical (like the bonding chemical) to the earth sections 37, 39, as described above.

The present invention is a system and method by which to create a seal between an open wellbore and a tubing by bringing the wellbore wall into sealing contact with the tubing. For its principal use, the present invention does not utilize prior art packers and therefore does not contain any of the difficulties found in deploying, activating, and maintaining such packers.

Figure 9:
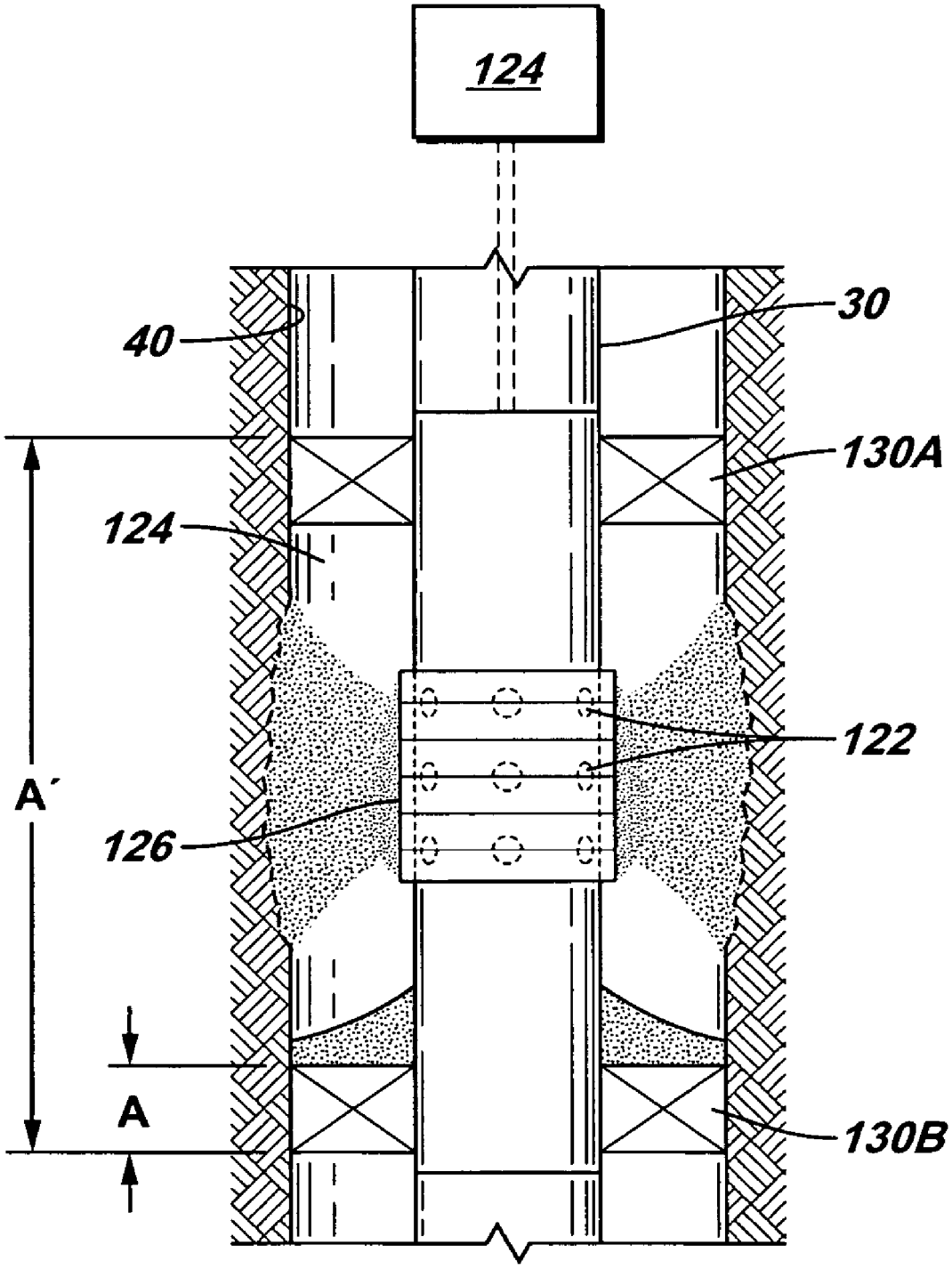
FIG. 9 shows another use for the present invention.

Another use of the present invention is shown in FIG. 9. In this embodiment, the sealing unit 50 is used to extend the sealing area created between two prior art packers. The operation of this embodiment is the same as the embodiment described in relation to FIG. 7, but instead prior art packers 130A, 130B are used to define the annulus 124 that is in communication with the at least one port 122. The prior art packers 130A, 130B can comprise rubber packers, cup packers, hydraulically set packers, electrically set packers, mechanically set packers, swellable packers, or any other packer known in the prior art. The present invention is useful as illustrated situations when the sealing area A provided by a single prior art packer is not large enough. For instance, in some cases fluid may flow through the earth from below a prior art packer (such as 130B) to above the prior art packer, if the sealing area (such as A) provided by such packer is not large enough. On the other hand, if the sealing area is increased to A" by the use of the present invention and another prior art packer (such as 130A), then the likelihood of flow across the sealing area A" is greatly reduced.

The present invention has been illustrated and described as being a replacement or enhancement to prior art packers in that the sealing area provided by the present invention is small relative to the length of the wellbore. However, the present invention can also be used to provide a sealing area that is substantial in relation to the wellbore length or that even comprises the entire or most of the wellbore length. For instance, the sealing area can be enlarged by enlarging the distance between the holder 54 and scraper arms 52 of FIGS. 3 and 4, the nozzles 90 and the holder 54 of FIG. 5, the explosives 100 and the holder 54 of FIG. 6, the cup sets 120A and 120B of FIG. 7, and the prior art packers 130A and 130B of FIG. 9. The sealing area can also be enlarged by incorporating additional scraper arms 52 (FIGS. 3 and 4), nozzles 90 (FIG. 5), explosives 100 (FIG. 6), outlets 110 (as in FIG. 8), and ports 122 (FIGS. 7 and 9).

Other embodiments are within the scope of the following claims. For example, although the seals created by the present invention were shown to be created in a vertical wellbore, the present invention and its seals may also be created in horizontal, inclined, or lateral tracks or wellbores. In other examples, the holder 54 of FIGS. 3, 4, 5, and 6 may be substituted by a cup set 120 of FIG. 7. Also, instead of using ports 122, the embodiments of FIGS. 7 and 9 may use ported collars (as known in the field). In addition, a downhole seismic vibrator can be used to cause the collapse of the wellbore wall instead of, for instance, the explosives 100 of FIG. 6. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

The invention claimed is:

1. A method to seal between a subterranean open wellbore wall and an interior tubing, comprising selectively bringing earth material of the subterranean wellbore wall inwardly towards the tubing to form a seal between the wellbore wall and the tubing.

2. The method of claim 1, wherein the bringing step comprises bringing the wall into sealing contact with the tubing.

3. The method of claim 1, wherein the bringing step comprises hydraulically unloading a section of the wellbore.

4. The method of claim 3, wherein the hydraulically unloading step comprises providing a fluid stream at the wellbore wall with enough force to dislodge portions of the wellbore wall.

5. The method of claim 4, wherein the hydraulically unloading step comprises collecting the portions to create the seal.

6. The method of claim 3, wherein the hydraulically unloading step comprises creating a suction area proximate the wellbore wall with enough force to dislodge portions of the wellbore wall.

7. The method of claim 6, wherein the hydraulically unloading step comprises collecting the portions to create the seal.

8. The method of claim 1, wherein the bringing step comprises explosively unloading a section of the wellbore.

9. The method of claim 8, wherein the explosively unloading step comprises creating an explosion towards the wellbore wall to dislodge portions of the wellbore wall.

10. The method of claim 9, wherein the explosively unloading step comprises collecting the portions to create the seal.

11. The method of claim 1, wherein the bringing step comprises swelling a portion of the wellbore wall.

12. The method of claim 11, wherein the swelling step comprises distributing a chemical on the wellbore wall.

13. A method to seal between a subterranean open wellbore wall and an interior tubing, comprising bringing the wall inwardly towards the tubing to form a seal between the wellbore wall and the tubing by mechanically unloading a section of the wellbore.

14. The method of claim 13, wherein the mechanically unloading step comprises scraping a portion of the wellbore wall.

15. The method of claim 14, wherein the mechanically unloading step comprises collecting the portions to create the seal.

16. A system for sealing between a subterranean open wellbore wall and an interior tubing, comprising a sealing unit adapted to move a wall of earth material inwardly towards the tubing to form a seal between the wellbore wall and the tubing.

17. The system of claim 16, wherein the sealing unit is adapted to bring the wall into sealing contact with the tubing.

18. The system of claim 16, wherein the sealing unit comprises at least one scraper arm to scrape a portion of the wellbore wall.

19. The system of claim 18, wherein the sealing unit comprises a holder to collect the portions to create the seal.

20. The system of claim 16, wherein the sealing unit comprises a pressurized fluid source and at least one nozzle, wherein the nozzle directs fluid from the source at the wellbore wall with enough force to dislodge portions of the wellbore wall.

21. The system of claim 20, wherein the sealing unit comprises a holder to collect the portions to create the seal.

22. The system of claim 16, wherein the sealing unit comprises a suction source and at least one port on the tubing, wherein the port provides fluid communication between the source and the wellbore wall and a suction area is created proximate the wellbore wall with enough force to dislodge portions of the wellbore wall.

23. The system of claim 22, wherein the sealing unit comprises a holder to collect the portions to create the seal.

24. The system of claim 16, wherein the sealing unit comprises at least one explosive, wherein the explosive creates an explosion towards the wellbore wall to dislodge portions of the wellbore wall.

25. The system of claim 24, wherein the sealing unit comprises a holder to collect the portions to create the seal.

26. The system of claim 16, wherein the sealing unit comprises a chemical source and at least one nozzle, wherein the nozzle distributes chemical from the source on the wellbore wall to swell the wellbore wall towards the tubing.

* * * * *